US008136438B2

(12) United States Patent
Shakespeare

(10) Patent No.: US 8,136,438 B2
(45) **Date of Patent: *Mar. 20, 2012**

(54) ARBORIST'S CLIMBING ROPE

(75) Inventor: William C. Shakespeare, Johnston, RI (US)

(73) Assignee: New England Ropes Corp., Fall River, MA (US)

( * ) Notice: Subject to any disclaimer, the term of this patent is extended or adjusted under 35 U.S.C. 154(b) by 132 days.

This patent is subject to a terminal disclaimer.

(21) Appl. No.: 12/660,786

(22) Filed: Mar. 4, 2010

(65) Prior Publication Data

US 2010/0162882 A1 Jul. 1, 2010

Related U.S. Application Data

(63) Continuation-in-part of application No. 11/893,066, filed on Aug. 14, 2007, now Pat. No. 7,703,372.

(51) Int. Cl.
*D04C 1/00* (2006.01)

(52) U.S. Cl. ..... 87/6

(58) Field of Classification Search ..... 87/6, 7, 87/8, 9, 13

See application file for complete search history.

(56) References Cited

U.S. PATENT DOCUMENTS

| | | | | |
|---|---|---|---|---|
| 2,737,075 | A | 3/1956 | Poirier et al. | |
| 3,030,851 | A | 4/1962 | Meyer | |
| 3,035,476 | A | 5/1962 | Fogden | |
| 4,170,921 | A | 10/1979 | Repass | |
| 4,258,608 | A | 3/1981 | Brown | |
| 4,321,854 | A | 3/1982 | Foote et al. | |
| 4,534,163 | A | 8/1985 | Schuerch | |
| 4,640,178 | A | 2/1987 | Kurzbock | |
| 4,677,818 | A | 7/1987 | Honda et al. | |
| 5,060,549 | A | 10/1991 | Beal | |
| 5,358,262 | A * | 10/1994 | Roberts | 277/652 |
| 5,699,657 | A | 12/1997 | Paulson | |
| 5,901,632 | A | 5/1999 | Ryan | |
| 5,931,076 | A | 8/1999 | Ryan | |
| 7,047,860 | B2 | 5/2006 | Faborsky | |
| 7,165,485 | B2 | 1/2007 | Smeets et al. | |
| 7,228,777 | B2 * | 6/2007 | Morissette et al. | 87/5 |
| 7,703,372 | B1 * | 4/2010 | Shakespeare | 87/6 |
| 2004/0199208 | A1 * | 10/2004 | Foerster | 606/228 |
| 2005/0204909 | A1 * | 9/2005 | Morissette et al. | 87/13 |

(Continued)

FOREIGN PATENT DOCUMENTS

CA 2005313 A1 6/1991

(Continued)

OTHER PUBLICATIONS

McKenna, H.A., Hearle W.S., O'Hear, Handbook of fibre rope technology, 2004, Woodhead Publishing, Cambridge.

(Continued)

*Primary Examiner* — Shaun R Hurley

(57) ABSTRACT

An arborist's climbing rope in which an eye splice having a splice tuck can be formed at one end includes in one embodiment a core of polypropylene, a first braided tubular sheath of nylon disposed about the core and a second braided tubular sheath of a polyester disposed about the first braided tubular sheath, the cross-sectional diameter of the fiber material of the core area being in the range of 1 to 10% of the total cross-sectional diameter of the arborist's climbing rope. In forming the eye splice a portion of the core is intentionally removed near the eye splice to form a space within the first tubular sheath where the core has been removed and the splice tuck is buried in and substantially completely fills the space within the first tubular sheath where the core has been intentionally removed.

19 Claims, 9 Drawing Sheets

U.S. PATENT DOCUMENTS

2005/0229770 A1 10/2005 Smeets et al.

FOREIGN PATENT DOCUMENTS

| | | | |
|---|---|---|---|
| DE | 7823387 | U1 | 11/1978 |
| EP | A-0150702 | | 7/1985 |
| FR | A 2166695 | | 8/1973 |
| GB | 979206 | A | 1/1965 |

OTHER PUBLICATIONS

Anonymous, Trawsteel II Premium Internet Article, Oct. 16, 2006.
Anonymous, IS-II Eye splice instructions, Internet Article 2006.
Anonymous, Yale Cordage Splicing Instructions, internet Article Nov. 28, 2006.

* cited by examiner

ARBORIST'S CLIMBING ROPE

CROSS-REFERENCE TO RELATED APPLICATIONS

This application is a continuation-in-part of U.S. patent application Ser. No. 11/893,066 filed on Aug. 14, 2007 now U.S. Pat. No. 7,703,372, in the name of William C. Shakespeare.

TECHNICAL FIELD

The present invention relates in general to ropes and pertains more particularly to arborist's climbing ropes.

BACKGROUND OF THE INVENTION

Various rope constructions have been developed over the years in response to market needs for performance improvements. Most notably, braided ropes, have substantially replaced the older, more traditional, stranded rope as the preferred construction for many different uses. The innovation in rope products since the introduction of the braided rope has related to the particular materials of the rope.

Increasingly, rope products are designed to meet increasingly more specific performance requirements. These requirements are becoming increasingly more market specific. With respect to one market, arborists, there continue to be a specific and unmet need, which the present invention seeks to meet. That need is the combination of a firm and uniformly shaped rope, and one which is yet easily spliceable. No climbing ropes have, to date, exhibited this mutually exclusive combination of user benefits, namely firmness and spliceability.

Arborist's climbing ropes must work precisely in cooperation with commonly used mechanical devices including friction hitches. These hitches and devices require rope firmness and dimensional uniformity to ensure quality-performance. Certain mechanical clearances in channeling a rope through braking devices, for example, may render those devices difficult to operate or even non-functional, if bulges in the rope are present.

In recent years some forms of double braided ropes have been used as climbing ropes due to the ease of splicing these ropes. This represents a compromise in performance because bulges in the rope are commonly exhibited when the rope is used in a braking device or a friction hitch. The user is presented with a conflicting choice of an inferior climbing rope which compromises firmness to enable splicing. Firm, uniform arborist's climbing ropes, by virtue of their design, have in the past been too tight to enable splicing.

Accordingly, it is an object of this invention to provide a new and improved arborist's climbing rope.

SUMMARY OF THE INVENTION

In accordance with the present invention an improved arborist's climbing rope structure is constructed so as to enable both a firm and uniform rope as well as ready splicing of the rope, particularly to form end loops or the like.

The arborist's climbing rope of this invention comprises a core of at least one yarn; a first (i.e. inner) braided tubular sheath disposed about the core; and a second (i.e. outer) braided tubular sheath disposed about the first braided tubular sheath. A superior arborist's climbing rope according to this invention can be constructed for the user in splicable form without compromise to its overall performance. The rope of the present invention combines the user benefits of firmness and ease in splicing without excessive dimensional irregularity. Important attributes of the present invention include a core within a double-braided rope; designed intentional removal of a portion of the core to enable ease in splicing; and substitution of the removed core with splicing tucks.

Rope firmness is driven by the need of the arborist's system requirements for safety. If the rope is not firm enough, the outer sheath will slide longitudinally along the rope axis relative to the inner sheath and/or core. The belay devices used in the art will jam with a loose sheath which has slipped and gathered into a wrinkly mass, thereby creating a threat to user safety. The core ensures rope stiffness is achieved simultaneously with splicability, the latter being achieved via evacuation of a portion of the core.

Thus, according to one aspect of this invention there is provided an arborist's climbing rope comprising a core of at least one yarn of fiber material; a first braided tubular sheath constructed of a plurality of strands of fiber material disposed about the core; and a second braided tubular sheath constructed of a plurality of strands of fiber material disposed about the first braided tubular sheath, the core cross-sectional diameter being on the order of between 1 and 10% of the total cross-sectional diameter of the arborist's climbing rope.

According to another aspect of this invention there is provided an arborist's climbing rope comprising a core of polypropylene; a first braided tubular sheath of a material selected from the group consisting of a polyester and nylon disposed about the core and a second braided tubular sheath of a polyester disposed about the first braided tubular sheath.

According to a further aspect of this invention there is provided an arborist's climbing rope having an eye splice at one end, said eye splice including a splice tuck, said arborist's climbing rope comprising a core of fiber material; a first braided tubular sheath of fiber material disposed about the core; and a second braided tubular sheath of fiber material disposed about the first braided tubular sheath; a portion of the core being intentionally removed near the eye splice to form a space within the first tubular sheath where the core has been intentionally removed; the splice tuck being buried in and substantially completely filling the spare within the first braided tubular sheath where the core has been removed to provide an arborist's climbing rope that is firm even where the portion of the core has been removed and wherein the external shape of the arborist's climbing rope is not substantially effected.

BRIEF DESCRIPTION OF THE DRAWINGS

Numerous other features and advantages of the present invention will now become apparent upon a reading of the following detailed description taken in conjunction with the accompanying drawings in which like reference numerals represent like parts and wherein.

DETAILED DESCRIPTION OF PREFERRED EMBODIMENTS

Figure 1:
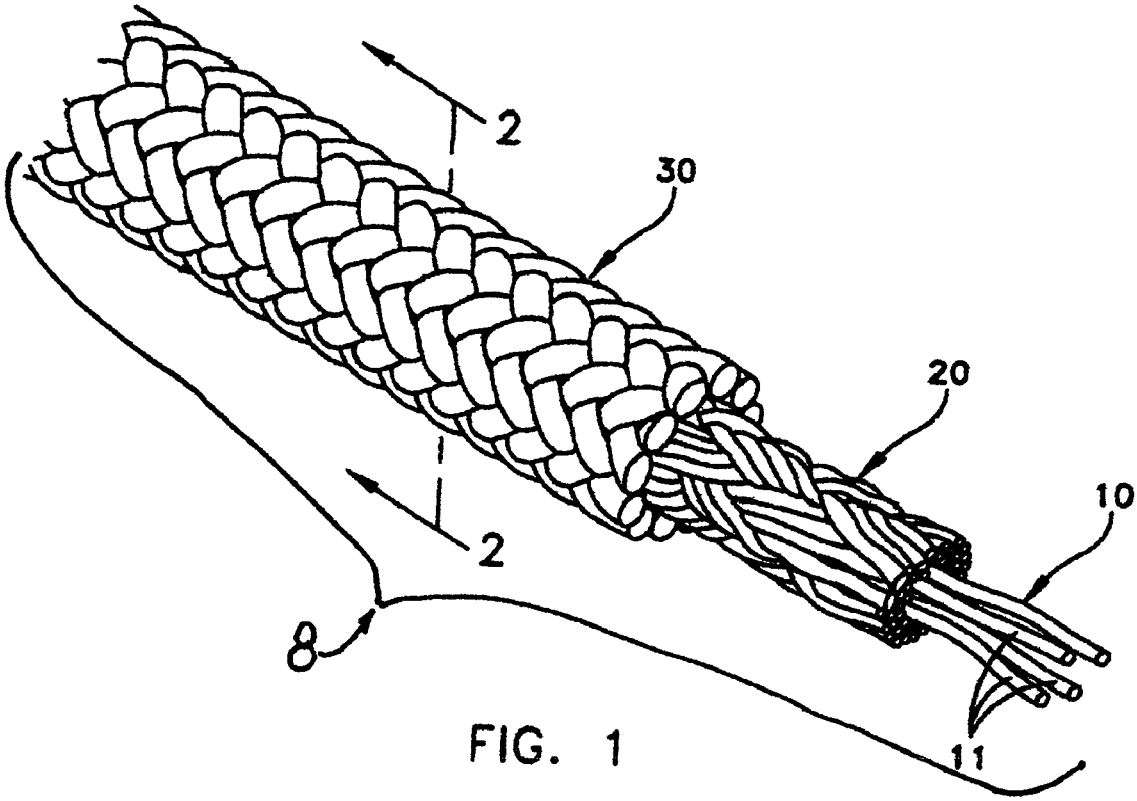
FIG. 1 is a perspective view illustrating one embodiment of a rope in accordance with the principles of the present invention.
Figure 2:
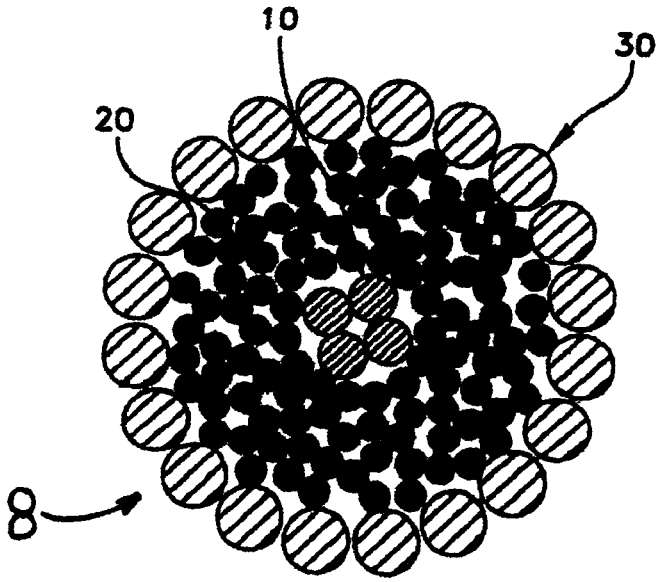
FIG. 2 is a cross-sectional view taken along line 2-2 of FIG. 1.

Reference is now made to the drawings in which FIGS. 1 and 2 illustrate one embodiment of the rope of the present invention, the rope being identified by reference numeral 8. FIGS. 3 through 9 show a sequence for forming a splice in rope 8. Rope 8, as illustrated in the drawings, is shown as being comprised of a core 10 of a plurality of yarns 11, a first braided tubular sheath 20 disposed about core 10 and a second braided tubular sheath 30 disposed about the first braided tubular sheath 20. The plurality of yarns 11 of core 10 is illustrated as substantially completely filling a center void formed by the first braided tubular sheath 20. Refer to the cross-sectional view of FIG. 4 showing the void at 12. The plurality of yarns 11 are preferably formed in an un-braided manner as either twisted or non-twisted yarns. By the selective removal of a portion of the core the rope is partially evacuated at is center to allow space for the bulk from the tucking operation within the splicing process to be buried without substantially affecting the rope's external shape, as described in further detail later. Because the splice tucks substantially account for the mass of the partially removed core, the rope section, whose core has been removed, retains its firmness by virtue of the fit of the tucks in the defined center space. Also, the remaining section of the rope also has the desired firmness as it retains the center core therein.

FIGS. 1-9 illustrate a low stretch static climbing rope that is spliceable. The diameter of rope 8 may be on the order of one-half inch or less. It is meant to meet EN 1891 standard with a tensile strength that exceeds 5400 lbs. The outer surface of rope 8 is to be relatively smooth so as to be free running, while also being both abrasion and pick resistant. Rope 8 is to hold knots well and yet be firm so as to not bind up in climbing equipment.

Second braided tubular sheath 30 may be, for example, a 24 strand construction with one yarn per strand to provide a smooth free running feel to the user. The braid pattern may be 12Z and 12S strands. The yarns may be, for example, of a twisted polyester for controlled stretch and abrasion resistance . Other types of braids may also be used with other strand patterns and constructions.

First braided tubular sheath 20 may be, for example, an 8 strand construction with 4 yarns per strand. The braid pattern may be 4Z and 4S strands. The middle braid may also be of a twisted polyester. The two braided sheaths may be formed with known braiding equipment so that the outer braid is formed over the inner braid. This may be achieved by setting a 16 braid in a tandem configuration and running it in a plain pattern braid. The equipment enables the middle braid to work with the cover braid, while providing a space (see void 12 in FIG. 4) for core 10. The three element construction maximizes the rope strength and minimizes sheath slippage. The yarns of the inner braid 20 may be a twisted nylon, which helps to provide the stretch desired to reduce the impact force in a fall.

Core 10 itself is illustrated as including four yarns. Yarns 11 may be constructed of twisted multi-filament polypropylene. Fewer or greater numbers of core yarns may be used and they may be in either a twisted or non-twisted form. The twisted multi-filament polypropylene yarns stretch with the other parts of rope 8, while firming rope 8 and both reducing weight and water absorption.

To provide a proper rope construction it has also been found that certain weight ratios are desirable in providing the desired firmness. Second braided tubular sheath 30, in one example, has a weight on the order of 52% of the total weight of the rope. The middle braid 20, in the example has a weight on the order of 44% of the total weight of the rope. Core 10, in the example has a weight on the order of 4% of the total weight of the rope. The preferred range of weight of the core 10 is 2-6% of the total weight. The core volume is preferably in a range of 12-15% of the total rope volume, but may be in a range up to 10-20% of the total volume of the rope.

The following are the steps taken in performing a splicing operation. These steps are merely illustrative of one way of performing a splicing operation. It being understood that there may be many other splicing techniques that can be practiced with the concepts of the present invention. In each case the center core is removed at the area of the splice so that the splice tucks are essentially substituted for the removed core material. The following are the steps using measurements for 7/16" rope for all marks. Use a small (or 5/160 fid when splicing.

Step 1

From the end of the rope measure back one full fid length (refer to a Fid Measurement Table) and make Mark "A".

Figure 3:
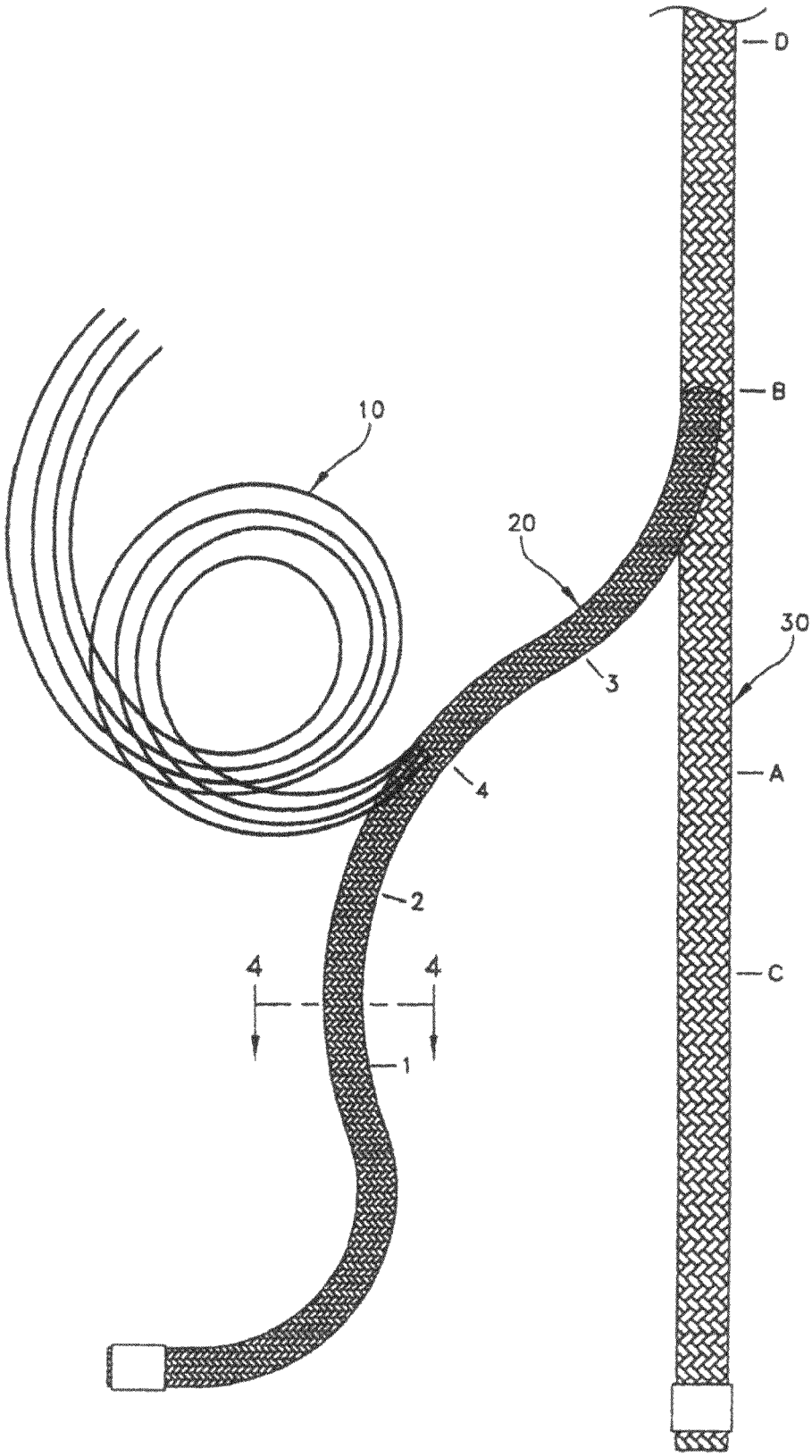
FIG. 3 is a schematic view of a first step taken in constructing a splice in the rope in FIG. 1.
Figure 4:
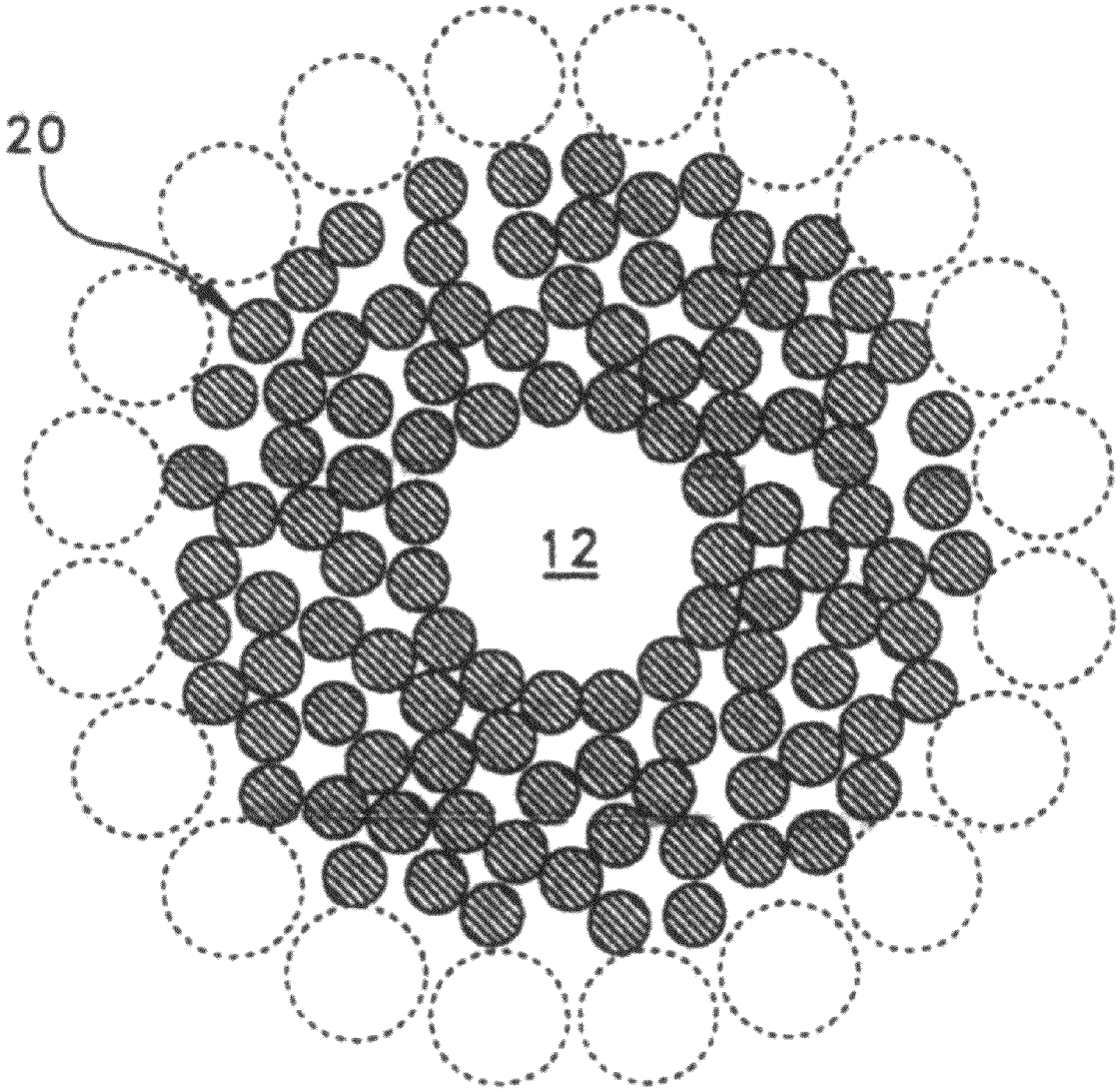
FIG. 4 is a cross-sectional view taken along line 4-4 of FIG. 3.

Using Mark "A" as a reference, form the desired size eye and make Mark "B" on the rope directly opposite Mark "A" as shown in, for example, FIG. 3.

From Mark "B" measure one long fid section (down the body of rope) and make Mark "D".

Figure 8:
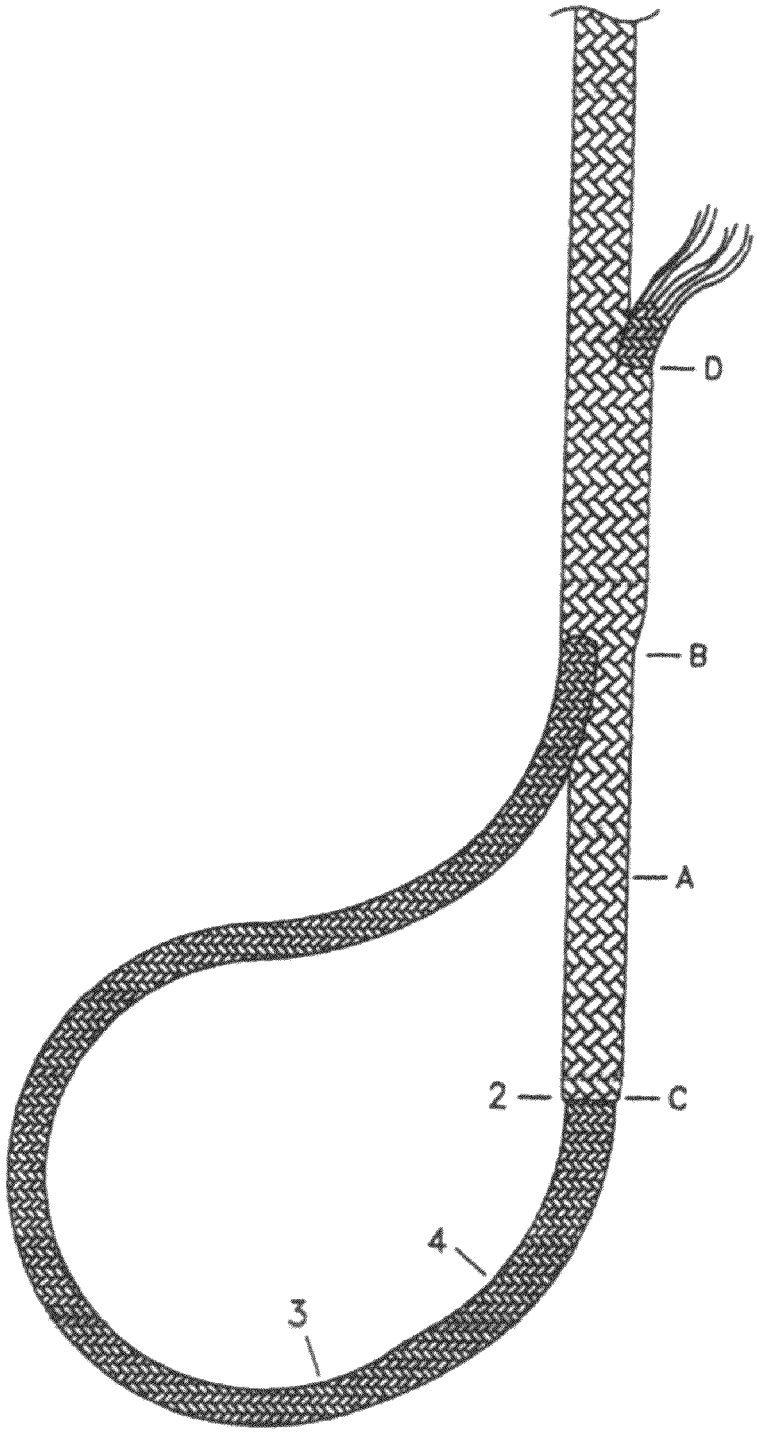

From Mark "D" measure down the rope approximately 5 full fid lengths and tie a slip knot or FIG. 8 knot in the rope.

From Mark "A" measure ½ a short fid length toward the end of the rope and make a heavy mark completely around the rope. This Mark "C".

From Mark "C" count nine consecutive left or right strands toward the end of the rope and mark the $9^{th}$ left and right strand pair. From this point count another four consecutive strands and mark the $4^{th}$ strand pair. Count another five consecutive strands and mark the $5^{th}$ strand pair. Continue counting and marking in this 4:5 sequence to the end of the rope.

Step 2

Bend the rope sharply at Mark "B" and carefully spread the cover strands to expose the core. Pry the core braid out from the cover. Use care to avoid pulling any strands. Pull the end of the core braid completely out of the cover. Tightly tape the end of both the cover and core braids. Holding the exposed core, slide the cover braid back to the knot. Then hold the knot and slide the slack cover back down the core in the direction of the end of the rope until all of the slack has been removed. Mark the core at that point where it exits from the cover. This is Mark "1". Once again slide the cover toward the knot. Measure one short fid length (see "Fid Measurement Chart") from Mark "1", toward the knot and make two marks that go completely around the core. This is Mark "2". From Mark "2" measure one full fid length plus a short fid length toward the knot and make three marks completely around the core. This is Mark "3". From Mark "2" measure a short fid length toward the knot and make a mark as this is Mark "4".

Step 3

Open the core braid at Mark "4" and pull the ends of the four blue inner strands out of the core braid. Refer to FIG. 3.

Step 4

Figure 5:
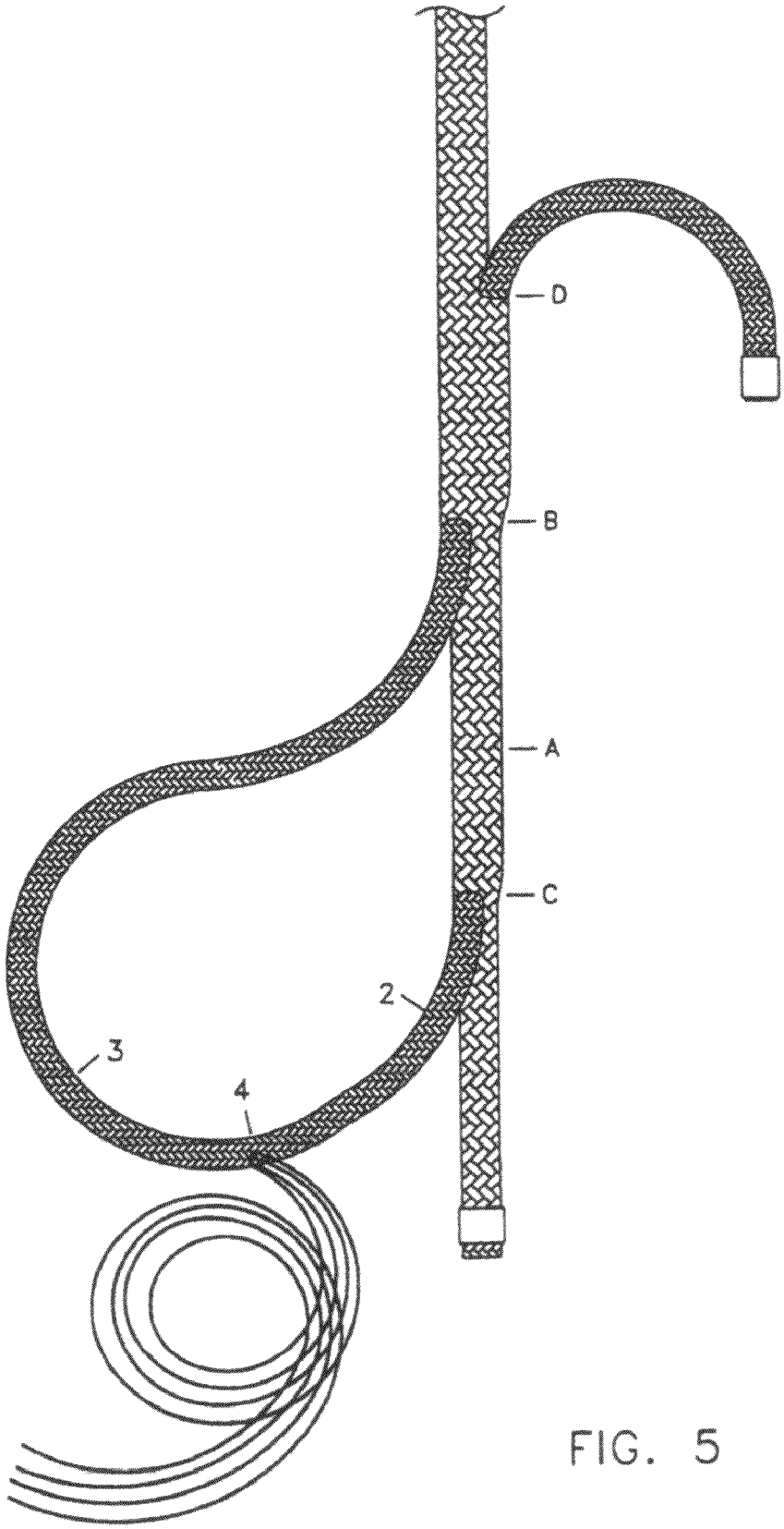
FIGS. 5, 6 and 8 are successive schematic view of further steps taken in constructing the splice in the rope.

Using masking tape place a wrap of tape (2") on the end of the core tail. Taper this by cutting the end at a 45 degree angle. Attach fid and inset the fid into the cover at Mark "C" and out at Mark "D". When exiting or entering the braid with the fid always go between strands. The rope may be extremely tight where the fid is traveling between Marks "C" and "D". To create more space in this area, grasp the core as it exists the cover at point "B" and pull extra core out of the rope. This will cause the cover to "Pucker" and give you some extra space. If the distance between "C" and "D" is longer than the length of the fid, hold the fid in place by squeezing it through the cover braid. Slide the cover slack back from the fid to Mark "C" to draw the core tail into the cover. The continue working the fid through the cover to Mark "D". Repeat as necessary. Avoid snagging the core with the tip of the fid when it is passing through the cover in the vicinity of Mark "B". To check if the core has been snagged, pull on the exposed core where it exists from the cover at Mark "B". If the core moves freely it is OK to proceed. If the core appears to be stuck, pull the Uni-Fid back until the core is no longer snagged and continue. Refer to FIG. 5.

Step 5

Cut and remove the marked strand pairs on the cover tail, working toward the end of the cover tail.

Step 6

Using masking tape place a wrap of tape (2") on the end of the cover tail. Taper this by cutting the end at a 45 degree angle. Attach the fid to the cover and tape the tapered point to the fid. Insert the fid into the hollow core at Mark "2" and out at Mark "3". Remove the fid and tape. Notice the loop at mark "C" after running the cover through the core. To remove this loop simply pull on the core exiting mark "D" until the loop disappears. (Marks "2" and "C" align).

Step 7

Figure 6:
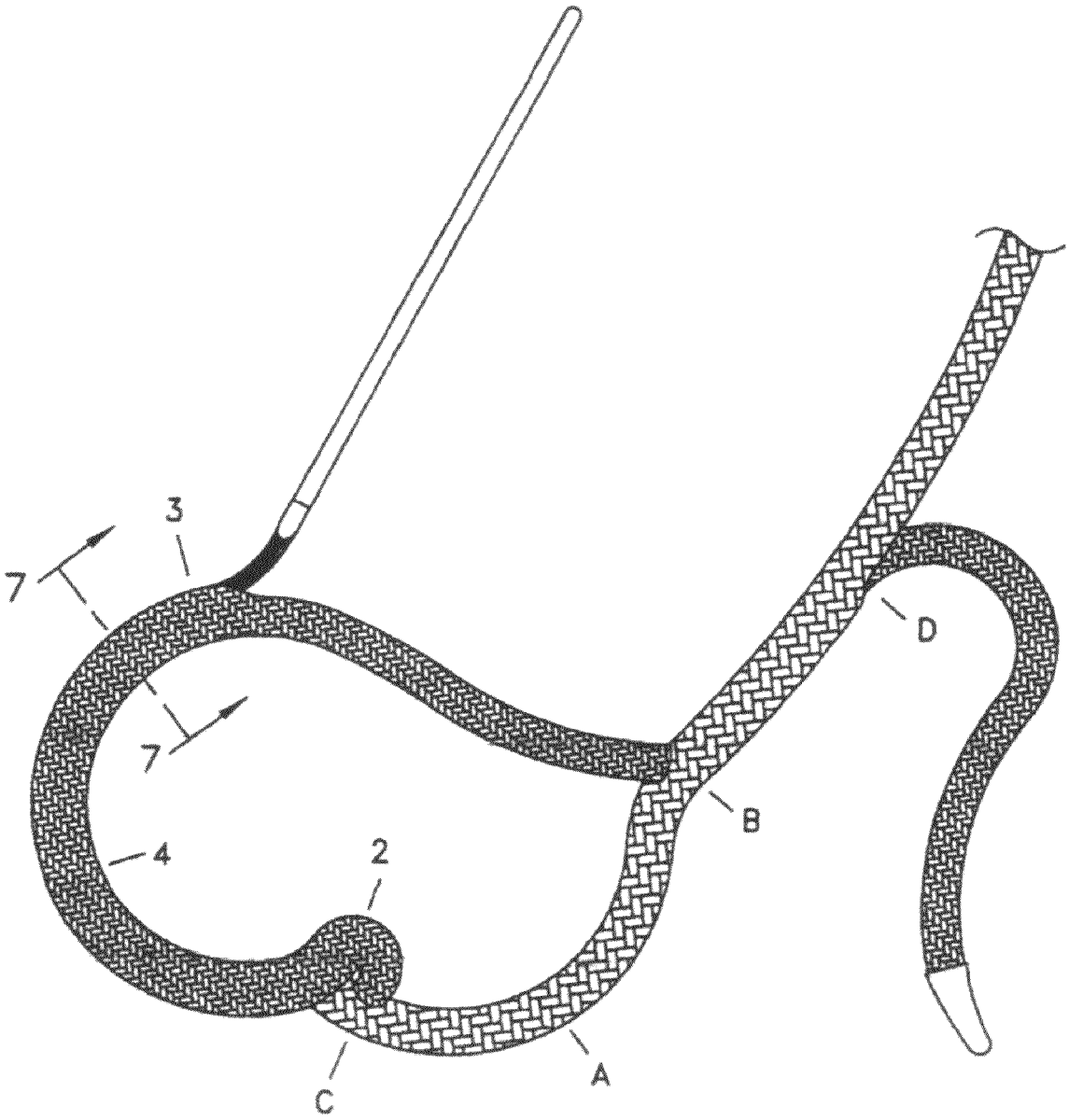

The crossover is the point where Mark "C" on the cover and Mark "2" on the core meet. To tighten, hold the rope at the crossover point and alternately pull on the free ends of the cover and core. Continue this process until the crossover is approximately the same diameter as the rope. Refer to FIG. 6.

Step 8

This involves burying the various tails. To bury the cover tail, hold the rope at the crossover and smooth the core toward the cover tail, which will disappear. For inner blue strands, cut off where they exit at mark "4". To bury the core tail, hold the crossover and smooth out the slack in the cover from the crossover down to Mark "D". Repeat this process several times to remove all cover slack. Most of the core will disappear; however, some of the core tail will still remain at mark "D" after this process. Mark the core tail where it exits from the cover at the Mark "D". Then mark the core tail at Mark "B" by inserting the marking pen into the opening at Mark "B". Pull out the core tail at Mark "D" until the mark made at "B" appears (approximately a long fid length). Cut off the excess core tail at the first mark (the one nearest the end of the core) and unbraid the core tail back to the second mark. Fan out the strands. Cut the strands at a 45 degree angle starting at a point about half-way back fro the end (between the two marks). Again, hold the rope at the crossover and smooth the cover braid from the crossover toward Mark "D". The exposed core will disappear completely inside the cover. Refer to FIG. 8.

Step 9

Secure the knot tied in the body of the rope to a solid anchor point. Since a good deal of tension may be placed on the rope when burying the splice, the anchor point should be very sturdy. The slack in the cover braid between the knot and Mark "B" will be used to bury the exposed core, crossover and cover down to Mark "A" to produce the desired size eye. This is accomplished by holding the rope at the top of the eye and sliding the cover slack back from the knot towards the splice. Milk the cover from the cross-over around the radius of the eye to the throat at "B" and the pull that leg sharply with a spike to help seat the space. Flex and/or hammer the splice section to loosen the fibers. If insufficient tension is placed on the rope while milking up the slack the crossover may tend to bunch up. If this happens, slide the cover slack back toward the knot until the crossover is the proper size. Then repeat the milking procedure.

Step 10

Figure 9:
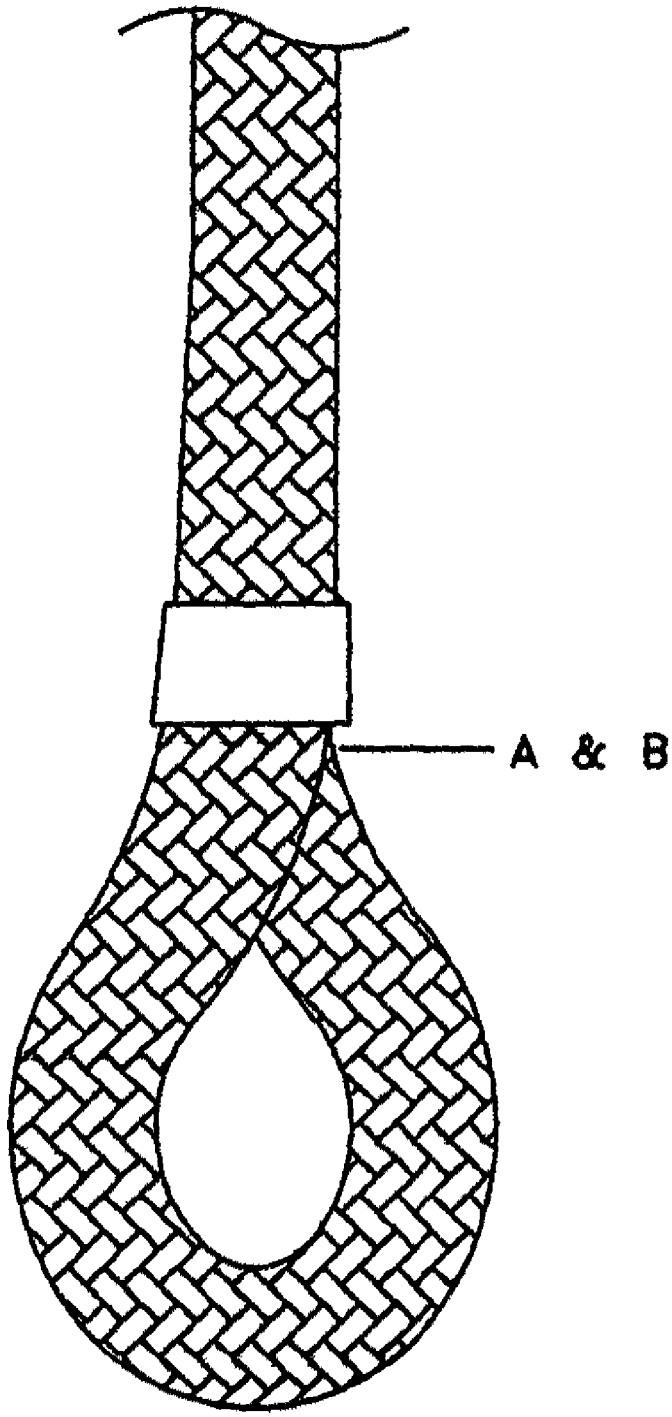
FIG. 9 illustrates the final rope splice.

Lock Stitch and Whip to complete the splice. Refer to FIG. 9

Figure 7:
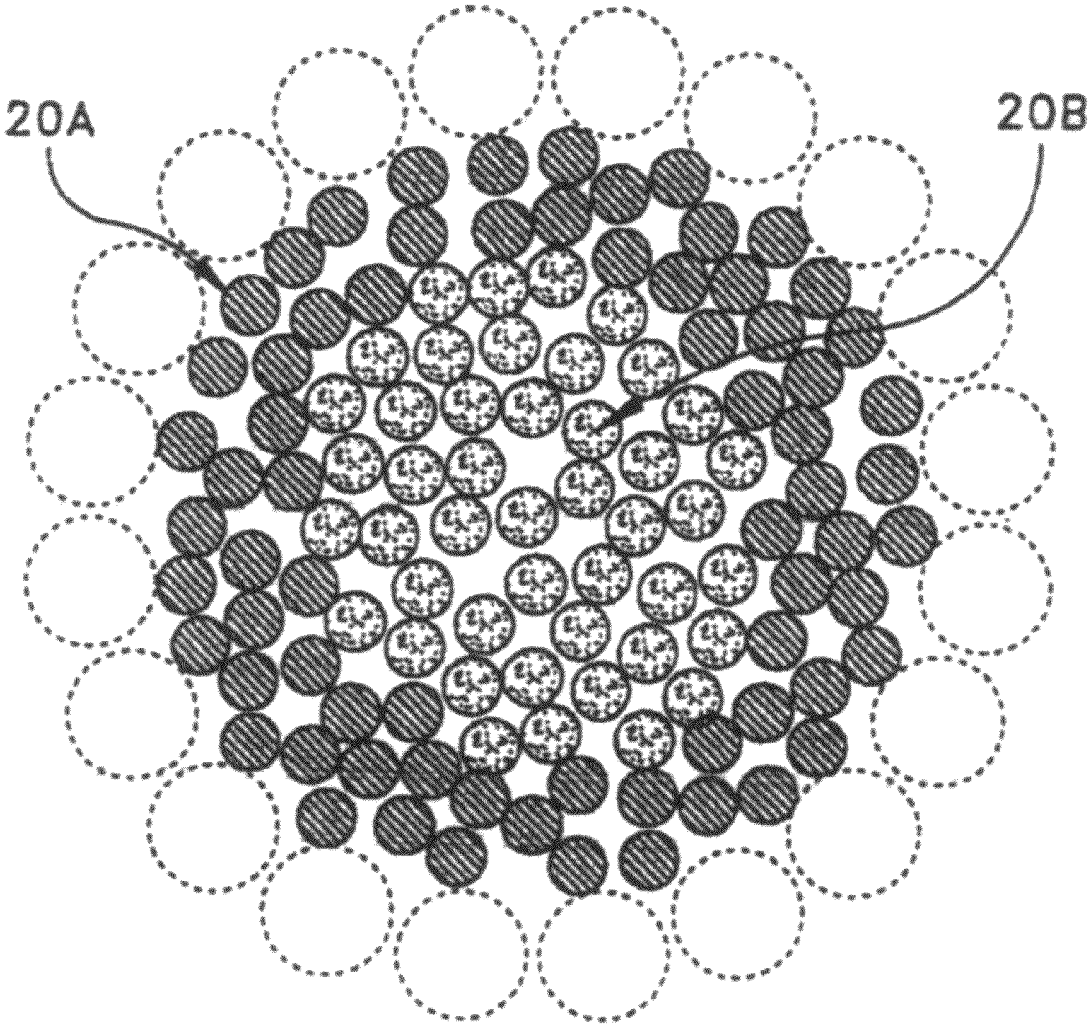
FIG. 7 is a cross-sectional view taken at line 7-7 of FIG. 6 showing the splicing tucks.

Reference is now made to FIG. 7 which is a cross-sectional view taken at line 7-7 of FIG. 6 showing the splicing tucks 20B that fill the center void area 12 within the middle braid indicated at 20A. This occurs during the splicing operation so that the splice remains firm. Outside of the splice area the center void is filled with the center core material as described before.

Figure 10:
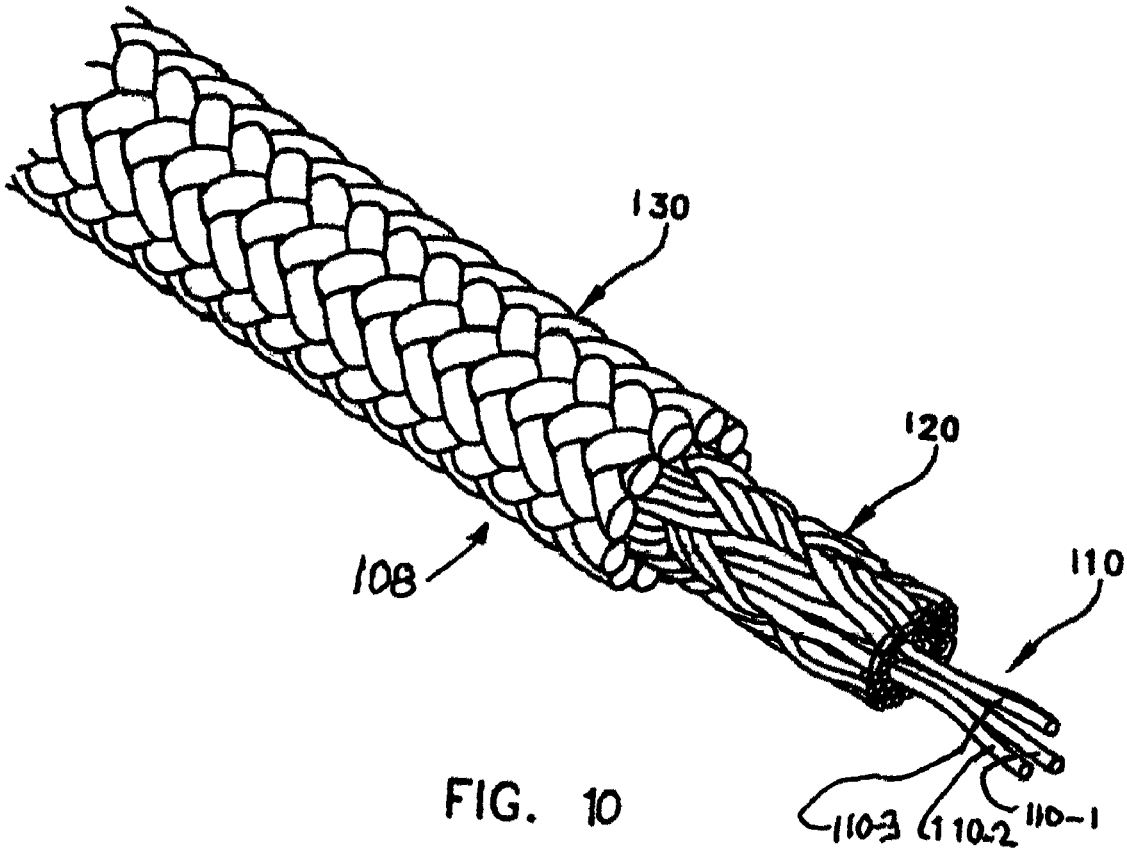
FIG. 10 is a perspective view of another embodiment of a rope construction according to this invention.

Referring now to FIG. 10, there is shown another embodiment of the rope of the present invention, the rope being identified by reference numeral 108. Rope 108 comprises a core 110 of three longitudinally extending, straight yarns 110-1, 110-2 and 110-3, a first (inner) braided tubular sheath 120 disposed about core 110 and a second (outer) braided tubular sheath 130 disposed about the first braided tubular sheath 120.

The threshold of percentage for the cross-sectional diameter of the fiber material of the core area as a proportion of the entire rope cross-sectional diameter should be near-zero, since the displacement of the "bury" is not tied to the available space occupied by the core. With increasing girth the core diminishes the balance of fiber in the other two components to render load bearing potential. Thus, the upper limit of the cross-sectional of the fiber material of the core area diameter should be no more than around 10%. This is because the ultimate tensile strength of the rope is diminished by a factor equal to the square of the difference between the smaller and the larger radii of the inner cores. Depending on the ultimate tensile strength required, the loss of strength-rendering yarn diminishes rapidly, then, with increase of diameter of core. However, the 5%-6% proportion would be sustained in a rope twice the diameter.

After splicing, the rope "grows" in diameter to accommodate the bury. This growth appears to be gradual due to the tapering done to the ends of the bury. However, the firmness of the spliced rope remains intact due to the presence of the inner core wherever it remains unevaluated, thus ensuring against sheath slippage and potentially consequential climbing system failure and a threat to user safety.

Rope 108 has a diameter on the order of 11 mm. and a tensile strength that exceeds 6000 lbs. The outer surface of rope 108 is relatively smooth so as to be free running, while also being both abrasion and pick resistant.

The three yarns 110-1, through 110-3 of core 110 are each twisted multi-filament polypropylene. Fewer (i.e. two or one yarns) or greater (i.e. four or more yarns) numbers of core yarns may be used and they may individually be in either a twisted or non-twisted form and either unconnected or connected to each other. In FIG. 10 the yarns are shown as non-twisted.

Cover braid 130 may be, for example, a 24 strand construction with one yarn per strand to provide a smooth free running feel to the user. The braid pattern may be 12Z and 12 S strands. The yarns may be, for example, of a twisted polyester for controlled stretch and abrasion resistance. Other types of braids may also be used with other strand patterns and constructions.

First braided tubular sheath 120 may be, for example, a 12 strand construction with 4 yarns per strand. The braid pattern may be 4Z and 4S strands. Second braided Tubular sheath 130 may also be of a twisted polyester. The two braids 120 and 130 may be formed with known braiding equipment so that the outer braid is formed over the inner braid. This may be achieved by setting a 16 braider in a tandem configuration and running it in a plain pattern braid. The equipment enables the inner braid to work with the outer braid, while providing a space for core 110. The three element construction maximizes the rope strength and minimizes sheath slippage. The yarns of the inner braid 120 may be a twisted nylon, which helps to provide the stretch desired to reduce the impact force in a fall.

As noted above, core 110 is illustrated as including three yarns 110-1, 110-2 And 110-3. Yarns 110-1, 110-2 and 110-3 may be constructed of a twisted multi-filament polypropylene. The twisted multi-filament polypropylene yarn stretches with the other parts of the rope, while firming the rope and both reducing weight and water absorption.

Having now described a limited number of embodiments of the present invention it should now be apparent to those skilled in the art that numerous other embodiments and modifications thereof are contemplated as falling within the scope of the present invention. For example, various types of braid constructions can be used and various types of braiding equipment can be used in forming the rope of this invention. Also, instead of being either nylon or a polyester first braided tubular sheath could be a mixture of nylon and polyester. Furthermore, various types of splicing techniques can be employed, as long as the splicing tucks are used to fill the formed void at the splice.

What is claimed is:

1. An arborist's climbing rope comprising a core of fiber material; a first braided tubular sheath of fiber material disposed about the core; and a second braided tubular sheath of fiber material disposed about the first braided tubular sheath; the core cross-sectional diameter of the fiber material of the core area being in the range of 1 to 10% of the total cross-sectional diameter of the arborist's climbing rope.

2. The arborist's climbing rope of claim 1 wherein the core comprises at least one yarn of fiber material.

3. The arborist's climbing rope of claim 2 wherein the core comprises three yarns of fiber material.

4. The arborist's climbing rope of claim 3 wherein the fiber material in each yarn in the core is twisted into a ply.

5. An arborist's climbing rope of claim 3 wherein the three yarns in the core are parallel.

6. The arborist's climbing rope of claim 4 wherein the three yarns are braided and not joined to each other.

7. The arborist's climbing rope of claim 4 wherein the three yarns are joined to each other.

8. The arborist's climbing rope of claim 2 wherein the core is polypropylene; the first braided tubular sheath is made of a material selected from the group consisting of a polyester and nylon; and the second braided tubular sheath is a polyester.

9. The arborist's climbing rope of claim 4 wherein the tensile strength of the arborist's climbing rope exceeds 6000 pounds.

10. The arborist's climbing rope of claim 9 wherein the first and second braided tubular sheaths are the primary load bearing members.

11. The arborist's climbing rope of claim 9 wherein the first braided tubular sheath comprises a twelve strand construction with four yarns per strand.

12. The arborist's climbing rope of claim 11 wherein the second braided tubular sheath comprises 24 strands, each strand having at least one yarn.

13. The arborist's climbing rope of claim 1 wherein the core is made of polypropylene the first braided tubular sheath is comprised of nylon and the second tubular sheath is constructed of a polyester.

14. The arborist's climbing rope of claim 1 wherein the first braided tubular sheath is a mixture of nylon and polyester.

15. The arborist's climbing rope having an eye splice at one end, said eye splice including a splice tuck, said arborist's climbing rope comprising:

(a) a core of fiber material;

(b) a first braided tubular sheath of fiber material disposed about the core; and (c) a second braided tubular sheath of fiber material disposed about the first braided tubular sheath;

(d) a portion of the core being intentionally removed near the eye splice to form a space within the first tubular sheath where the core has been removed;

(e) the splice tuck being buried in and substantially completely filing the space within the first tubular sheath where the core has been intentionally removed to provide an arborist's climbing rope that is firm even where the portion of the core has been removed and wherein the external shape of the arborist's climbing rope is not substantially affected.

16. The arborist's climbing rope of claim 15 wherein the core is constructed of polypropylene, the first braided tubular sheath is constructed of nylon, and the second braided tubular sheath is constructed of a polyester.

17. The arborist's climbing rope of claim 15 wherein the fiber material in the core, the first braided tubular sheath and the second braided tubular sheath are each a synthetic fiber material.

18. The arborist's climbing rope of claim 17 wherein the cross-sectional diameter of the fiber material of the core area is in the range of 5 to 6% of the total cross-sectional diameter of the arborist's climbing rope.

19. The arborist's climbing rope of claim 1 wherein the arborist's climbing rope further includes:

(a) an eye splice at one end, said eye splice including a splice tuck;

(b) a portion of the core being intentionally removed near the eye splice to form a space within the first tubular sheath where the core has been removed; and (c) the splice tuck being buried in and substantially completely filling the space within the first tubular sheath where the core has been intentionally removed to provide an arborist's climbing rope that is firm even where the portion of the core has been removed and wherein the external shape of the arborist's climbing rope is not substantially affected.

* * * * *

UNITED STATES PATENT AND TRADEMARK OFFICE

CERTIFICATE OF CORRECTION

PATENT NO. : 8,136,438 B2
APPLICATION NO. : 12/660786
DATED : March 20, 2012
INVENTOR(S) : William C. Shakespeare It is certified that error appears in the above-identified patent and that said Letters Patent is hereby corrected as shown below:

Col. 8, Claim 15, line 1, "The" should be changed to --An--.

Signed and Sealed this
Twenty-ninth Day of May, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,136,438 B2
APPLICATION NO. : 12/660786
DATED : March 20, 2012
INVENTOR(S) : William C. Shakespeare It is certified that error appears in the above-identified patent and that said Letters Patent is hereby corrected as shown below:

Column 8, line 16 (Claim 15, line 1) "The" should be changed to --An--.

This certificate supersedes the Certificate of Correction issued May 29, 2012.

Signed and Sealed this
Nineteenth Day of June, 2012

David J. Kappos

David J. Kappos
*Director of the United States Patent and Trademark Office*